United States Patent [19]

Wade

[11] 4,221,429

[45] Sep. 9, 1980

[54] SUSPENDED RECLINER

[75] Inventor: Mark W. Wade, Boynton Beach, Fla.

[73] Assignee: James Nemec, Palm Beach, Fla. ; a part interest

[21] Appl. No.: 946,841

[22] Filed: Sep. 28, 1978

[51] Int. Cl.[2] ..... A45F 3/22

[52] U.S. Cl. ..... 297/277; 5/121; 297/184

[58] Field of Search ..... 297/277, 278, 279, 273; 5/128, 129, 123, 127, 120, 121

[56] References Cited

U.S. PATENT DOCUMENTS

| | | | |
|---|---|---|---|
| 580,076 | 4/1897 | Wohler | 297/277 |
| 656,639 | 8/1900 | Gundlach | 297/278 X |
| 925,044 | 6/1909 | Shultz | 5/130 |
| 968,017 | 8/1910 | Wilson | 5/121 |
| 1,066,991 | 7/1913 | Brogley | 297/279 X |
| 1,182,185 | 5/1916 | Lyson | 5/121 X |
| 2,450,689 | 10/1948 | Richmond | 5/129 |
| 3,528,657 | 9/1970 | Krupsky | 297/277 X |

*Primary Examiner*—Francis K. Zugel

*Attorney, Agent, or Firm*—Clarence A. O'Brien; Harvey B. Jacobson

[57] ABSTRACT

A suspended recliner is provided with a leg support area which depends vertically downward from the main body of the recliner. When an individual enters the recliner, the leg support may be left in its depending position, thereby providing a chair-like support for the occupant, or the weight of the occupant may be used to provide a force to position the footrest in an aligned configuration with the main body of the recliner. The footrest is provided with a locking device to maintain this position. With the footrest locked in place, the occupant may shift his position in the hammock to provide a semi-reclining support or a totally horizontally deployed hammock with the main portion providing a sling-type chair support with the juncture of the footrest and main portion generally coinciding with the knees of the occupant. Also, the device is equipped with a centrally located vertical hanging support which requires only a single mounting point from which to hang the entire suspended recliner. Further, an unique supporting frame is provided for use with the suspended recliner which frame extends over the suspended recliner and gives the user a convenient point from which to suspend the recliner.

10 Claims, 18 Drawing Figures

10
12
14
16
18
20
22
24
26
28
30
32
34
36
38
40
42
48
50
52
60
61
62
68

10
12
14
16
18
20
22
28
30
30'
32
42
48
50
52
60
64
66
7

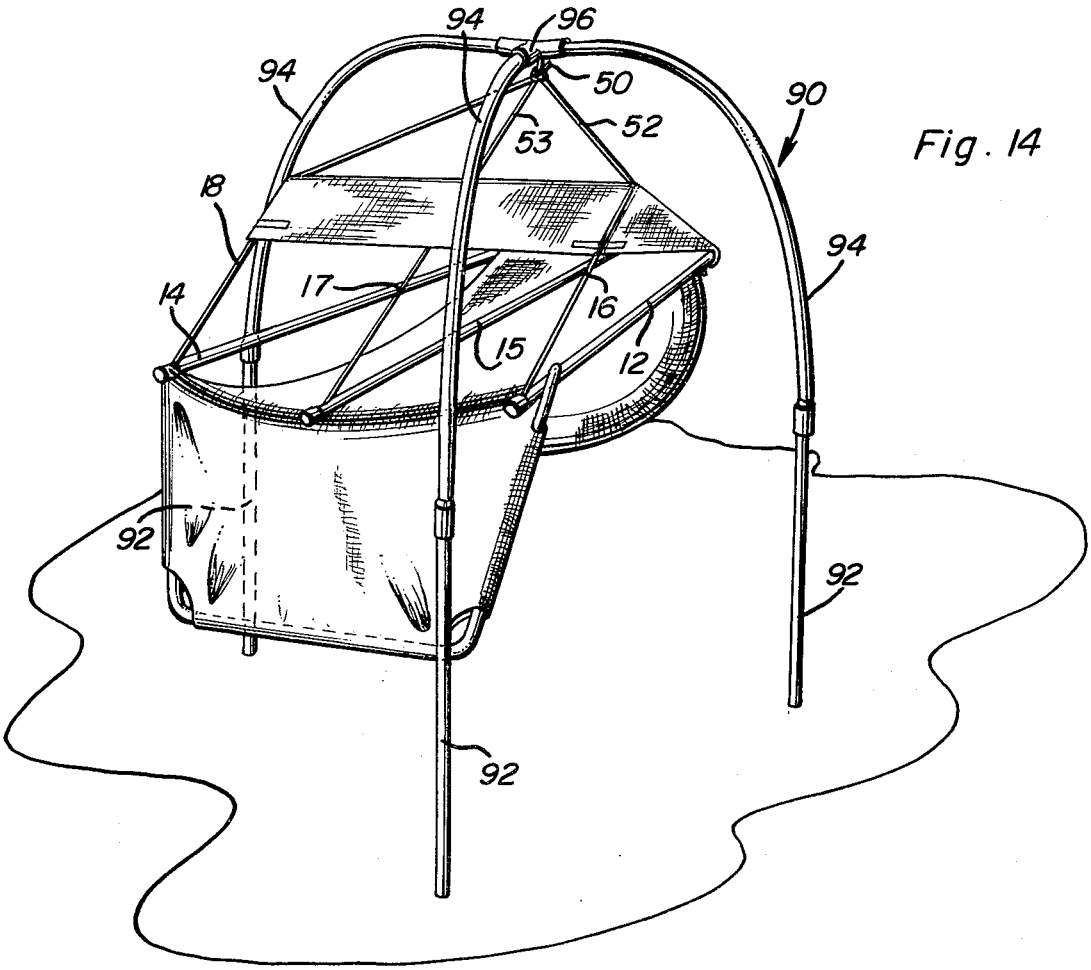
Fig. 14
Fig. 15
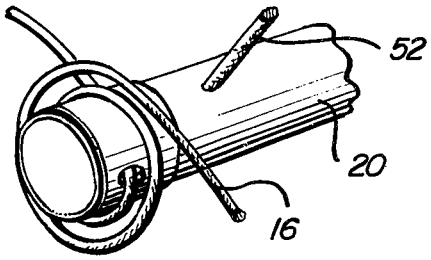
Fig. 16
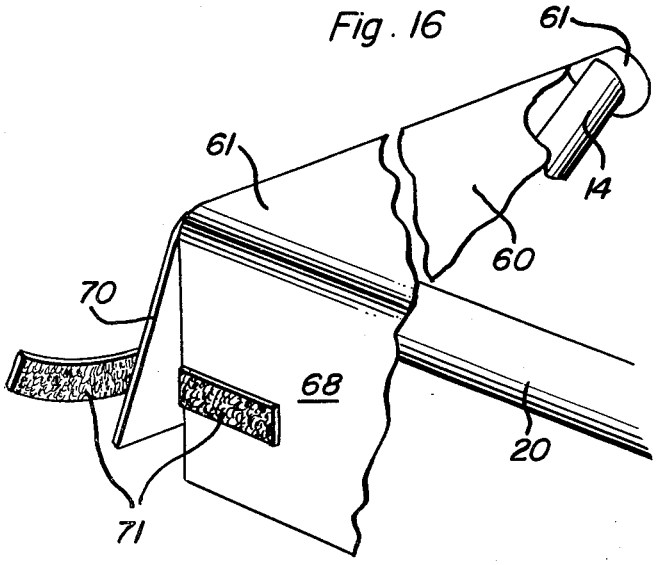

SUSPENDED RECLINER

BACKGROUND OF THE INVENTION

1. Field of the Invention

This invention relates to suspended body support devices in general and particularly to suspended recliners which may be hung by a single point and have leg rests which may be positioned at various angular orientations.

2. Description of the Prior Art

Hammocks have been known and used for many years as a means of relaxation. These prior known hammocks have been plagued with various deficiencies however. Notable among these deficiencies has been the lack of ease of entry to and exit from the hammock. A great deal of effort has normally been required in order to allow one to enter or exit from the hammock as these prior hammocks have been known to swing out of the way of a user. This particular deficiency is especially notable as one reaches the later stages in life and one's agility and aptitude in dealing with these situations necessarily decreases.

Certain prior art hammocks have also been provided with means whereby the leg portion of the user may be varied as desired. This feature is particularly useful when one wishes to change position to conduct such activities as reading, wherein a more upright position would be desirable as compared to a reclining position which is preferable for sleep. Certain hammocks which provide this adjustability feature are unduly complicated and are, therefore, given to frequent repair and adjustments.

The normal hammock as it has evolved through the decades requires a two-point hanging system whereby two positions in which opposite ends of the hammock must be attached are necessitated with the positions being the proper distance from one another in order to provide the hammock with the proper support. This requirement has necessitated the development of special racks on which hammocks may be hung.

Prior known hammocks include U.S. Pat. No. 370,222, issued Sept. 20, 1887, to Travers. The Travers patent shows a hammock-chair in which the footrest will be automatically put into position when a person enters the hammock. This device requires a two position suspension device as well as lacks an adequate locking mechanism for holding the footrest in a horizontal position once it has been placed in that position. U.S. Pat. No. 595,336, issued Dec. 14, 1897, to Palmer, shows a hammock attachment in which provision is made for interrupting the natural curve of the hammock to form a seat for the convenience of the occupant and also provides a footrest attachment capable of adjusting to hold the lower limbs in different positions. The Palmer device again requires a two point hanging mechanism and requires a very complex mechanism to perform its intended function. U.S. Pat. No. 614,621, issued Nov. 22, 1898, to Palmer, discloses a hammock which is bifurcated throughout a portion of its length to provide a footrest. U.S. Pat. No. 645,805, issued Mar. 20, 1900, to Graham, contemplates a hammock having separated portions on each end which portions are suspended by separate suspension means. In this way, the head and the feet of the occupant may be individually adjusted as desired. U.S. Pat. No. 777,919, issued Dec. 20, 1904, to Randall, shows a convertible hammock and hammock chair wherein a plurality of ropes are attached along the length of the hamock and by adjusting tension on the ropes, various positions of the hammock may be provided.

SUMMARY OF THE INVENTION

In order to overcome the above discussed deficiencies of the prior art hammocks, the present invention provides for a suspended recliner to be maintained in a stable position by the use of a single hanging point. The instant suspended recliner also provides a two-position footrest which footrest is activated by the weight of the occupant and is held in place by a unique friction lock.

It is an object of the present invention to provide an inexpensive, durable and useful suspended recliner which provides an easy means of ingress due to the fact that the footrest depends from the main portion of the body of the recliner thereby allowing the main portion to be easily accessible to the user.

Another object of the present invention is to provide a suspended recliner which facilitates the means of egress therefrom by the expedient of allowing the occupant to force the footrest into a depending position once again in order to allow the user to be placed in a position from which he may easily assume a standing position free of the recliner.

Yet a still further object of the present invention is to provide a suspended recliner which may be assembled or disassembled easily. In this manner, the recliner may be rolled up into a conveniently sized package for storing and yet will be able to be deployed for use quickly and easily.

Yet another still further object of the present invention is to provide a suspended recliner in which the means for support consists of a single support point positioned above the recliner and out of the way of the occupant.

Yet another still further object of the present invention is to provide a suspended recliner which has a canopy which may be positioned above the head and body of the occupant in order to protect the occupant from the heat of the day.

It is another object of the present invention to incorporate the hanging device and the canopy support together in a single unit, thereby decreasing the cost of manufacture of the device.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 14 is a perspective view of a second embodiment of the present invention.

FIG. 15 is an enlarged view of a modification of the recliner necessary when using the recliner in the chair position.

FIG. 16 is an enlarged view of the awning attachment of the present invention.

DESCRIPTION OF THE PREFERRED EMBODIMENT

Figures 1, 4, 5, 7, 8:
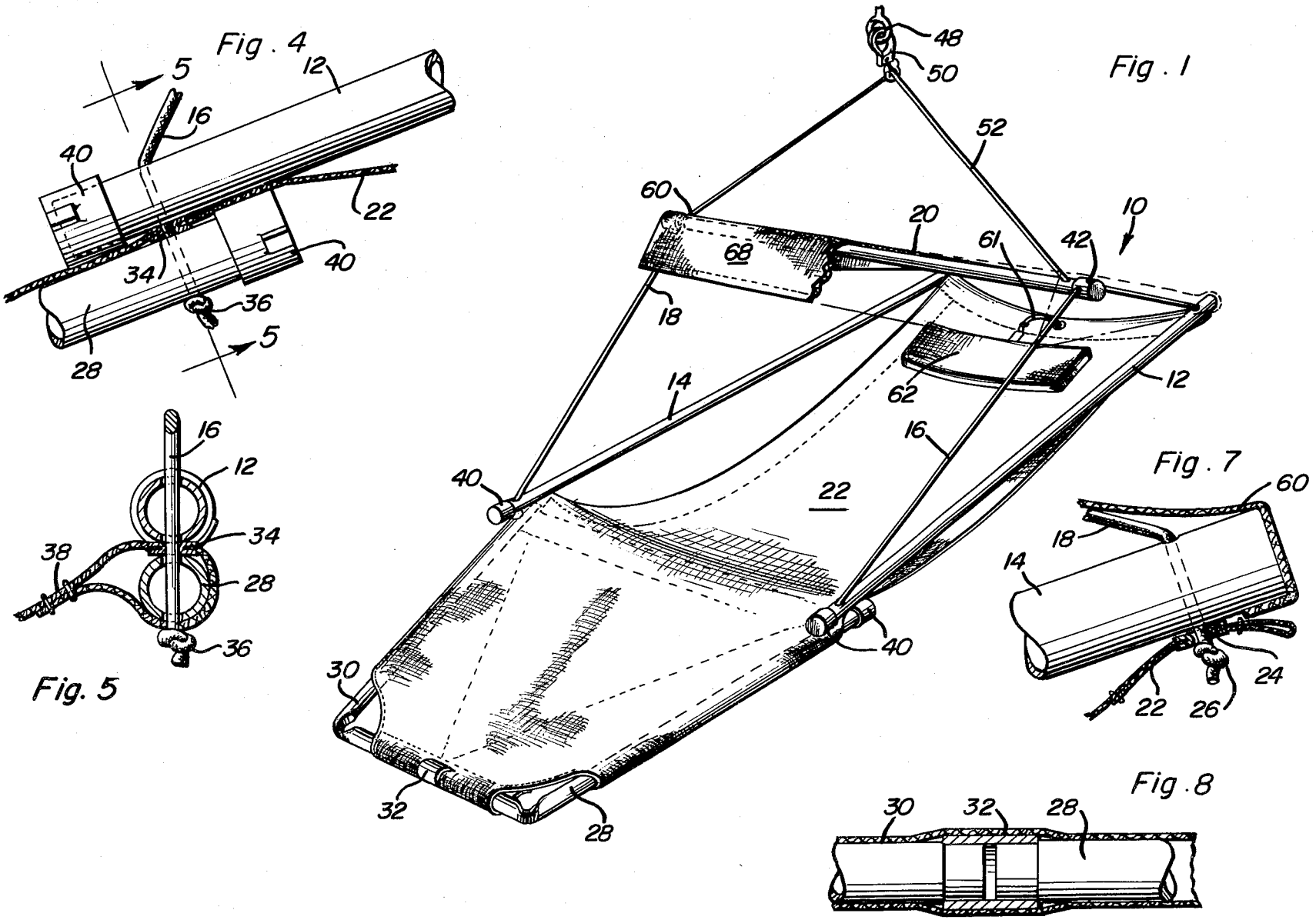
FIG. 1 is a part sectional perspective view of the suspended recliner shown hanging with the footrest in a horizontal position.
FIG. 4 is an enlarged view of the friction locking device of the present invention.
FIG. 5 is a sectional view taken substantially along a plane passing through section line 5—5 of FIG. 4.
FIG. 7 is a fragmental sectional view taken substantially along a plane passing through section line 7—7 of FIG. 3.
FIG. 8 is an enlarged view of the connection device of the footrest.

Now with reference to the figures, the suspended recliner device of the present invention will be clearly explained. The recliner itself is generally designated by the numeral 10. As seen with reference to FIG. 1, the recliner 10 has a main body portion which is given shape by spreader bars 12 and 14. Support ropes 16 and 18 extend through the spreader bars 12 and 14 and vertically support them. These support ropes 16 and 18 are held apart by bridle 20 through which they pass on the opposite ends thereof. The spreader bars 12 and 14 and bridle 20 may preferably be made of a molded plastic, hollow aluminum tubing, or any other suitable material.

Figures 2, 3, 6, 9, 10:
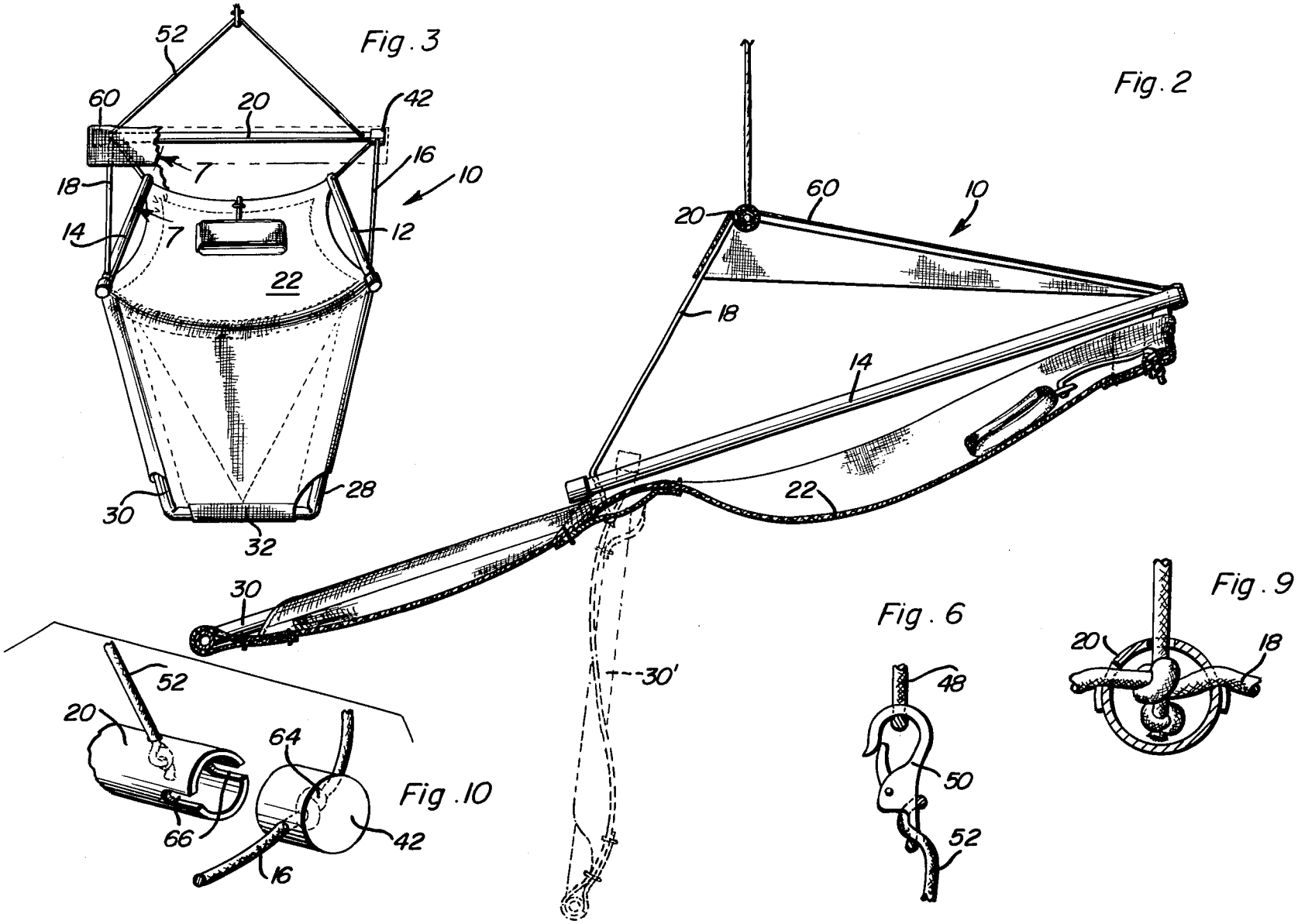
FIG. 2 is an elevational sectional view of the suspended recliner showing the two position footrest.
FIG. 3 is an elevational frontal view of the suspended recliner.
FIG. 6 is an enlarged view of the hook used for suspension of the suspended recliner.
FIG. 9 is an enlarged view of one end of the suspended recliner bridle.
FIG. 10 is an enlarged exploded view of one end of the suspended recliner bridle.

The recliner material, shown at 22, is reinforced at the top end and connected to spreader bars 12 and 14 as shown in FIGS. 3 and 7. A grommet 24 is inserted in the recliner material 22 and support rope 18 is passed through spreader bar 14, grommet 24 and held in place by knot 26, tied in the end thereof. In this manner, material 22 is held to the bottom of support bars 12 and 14.

The footrest of the present invention is shown to be given shape by foot braces 28 and 30 as seen in FIGS. 1, 2 and 3. The foot braces extend from spreader bars 12 and 14 with angled sections that extend toward one another and are connected together by coupling 32 as shown in FIG. 8. With coupling 32 in place, the elements 28, 30 and 32 provide a rigid frame which defines the footrest. The footrest is connected to the main body of the recliner by support ropes 16 and 18 which pass through spreader bars 12 and 14 and then pass through foot braces 28 and 30 as seen in FIGS. 1, 2, 3 and 4. The recliner material 22, which may be of light canvas or nylon-type material preferably of a ventilated nature, passes between the spreader bars and the respectively connected foot braces as shown clearly in FIG. 4. With reference to FIGS. 4 and 5, it will be seen that support rope 16 passes through spreader 12 and then through a grommet embedded in the material 22 and labelled 34. The rope then passes through foot brace 28 and knot 36 is tied in the end of the rope. Recliner material 22 is attached to foot brace 28 by stitching 38 which attaches the free end of the recliner material to the body of the recliner material after the free end has passed around foot brace 28. It will also be noted that end caps 40 are provided on the free ends of each of the spreader bars and foot braces which come into contact with one another.

The operation of the footrest will now be explained with reference to FIG. 2. With no occupant in the hammock device, it will be seen that the footrest will take the position shown in phantom and labelled 30' in FIG. 2. In this position, the free ends of foot braces 28 and 30 extend outside of spreader bars 12 and 14, thus producing a convoluted shape in the ends of support ropes 16 and 18. With a downward force caused by a person entering the main body of the hammock, pressure is placed on the knot 36 as seen in FIG. 4, thus causing support rope 16 to straighten and in like manner support rope 18 will straighten, thus bringing the foot braces 28 and 30 into vertical alignment with spreader bars 12 and 14. This causes foot braces 28 and 30 to take on a horizontal orientation as shown in FIGS. 1, 2 and 4. With reference to FIG. 4, it will be seen that this orientation is maintained so long as tension exists in ropes 16 and 18 so as to hold spreader bars 12 and 14 in alignment with braces 28 and 30, since in this position end caps 40 of each spreader bar and brace will apply pressure in a manner which will effect a frictional lock of each spreader bar and its respective foot brace. The ends on which the caps 40 are attached act as lever arms and in this manner provide a firm frictional engagement. It will also be noted that with a slight initial pressure, the foot brace may be again positioned in its vertical orientation and with a sustained pressure provided by the occupant, the foot brace may be maintained in this vertical orientation whereupon, with the weight shift of the occupant thus effected, the orientation of the entire device will change slightly, thus enabling a sitting up position of the occupant to be assumed.

The entire device may be easily hung from a hook or ring 48 as seen in FIG. 1 and FIG. 6. A snap hook 50 cooperates with ring 48 and is connected to suspension rope 52 by means of, preferably, a knot. Suspension rope 52 is connected to bridle 20 as seen in FIGS. 1, 2 and 3. Suspension rope 52 extends to the interior of bridle 20 through a hole disposed in the bridle for that purpose and is tied to support rope 18, as shown in FIG. 9. On the opposite end of bridle 20, suspension rope 52 is connected to the bridle by a knot disposed in the end of the rope as shown in FIG. 10. Support rope 16 passes through cap 42 and a knot 64 is tied in the rope inside of cap 42 to keep the rope from shifting with respect to the cap. Slots 66 are cut in the end of bridle 20 to receive support rope 16 when cap 42 is connected to the bridle. As seen in FIGS. 1 and 3, with cap 42 in place, the lateral forces exerted by support rope 16 will keep the cap in its proper position. With this manner of fastening, the cap 42 may be removed from bridle 20, thus allowing the bridle to be positioned longitudinally in relation to the suspended recliner to facilitate the folding of the recliner for storage when not in use.

An awning or canopy 60 is provided and is advantageously positioned on the structural support members of the recliner thus eliminating the need for any additional members devoted strictly to supporting the awning. The awning consists of a light canvas or nylon material similar to the material of the recliner itself. As seen in FIGS. 7 and 16, the awning may be attached by providing proper shape to the material for it to fit over the ends of spreader bars 12 and 14. Additionally, elastic straps 61 may be provided on the awning to hold it firmly in place on these bars. The awning extends up toward bridle 20 and rests on support ropes 16 and 18. The awning extends over the bridle and has a small flap 68 in the front thereof which also rests upon the support ropes 16 and 18. Side flaps 70, as seen in FIG. 2, are provided to give the awning shape and to allow it to rest conveniently upon the recliner supports as discussed. Additionally, elastic straps 61 may be provided in the front of the awning to securely fasten it to bridle 20. The side flaps 70 may be advantageously secured to front flap 68 by the use of a removable attaching means such as the Velcro strips shown at 71. With this construction of an awning supported over the recliner, the occupant may rest his head upon pillow 62 attached to the recliner by a cord 61 and be protected from the rays of the sun overhead, or, alternatively, the user may unfasten the Velcro strips 71, remove the awning and bask in the sun's rays. The ease of removal inherent in using this attachment arrangement provides the recliner with great versatility.

In use, the suspended recliner is removed from a convenient storage bag supplied with it and coupling 32 is connected together thus forming the footrest. End cap 42 is connected to bridle 20 thus forming the vertical support for the hammock and snap hook 50 is connected to any convenient support, such as ring 48, which could, for instance, be connected to a rope tied to a tree limb. The user approaches the hammock from the front with the leg rest in a vertically depending position and enters simply by sitting on the main body portion of the hammock. Upon leaning back, the pressure applied will cause the footrest to assume a horizontal position and is thereupon locked in place by the friction locking device described supra. If the occupant wishes to leave the hammock or merely assume a sitting position, he can apply a force to the footrest which will produce the downward depending position and with a slight force, the footrest may be maintained in this position. With the footrest depending downwardly, the occupant has easy access to the ground and thereby is provided with a ready exit from the recliner.

Now with reference to FIGS. 11 through 13, the suspended recliner will be described with reference to three of the positions assumable by the recliner. Also, these figures show unique support frame 70 for suspension of the recliner. It will be noted that this support frame has a base portion 72 comprised of channel bars 74 connected so as to form a cross. These channel bars may be welded, bolted, or connected by any other suitable means. A bowed support member 76 is connected by means of, for example, welds to one channel bar 72 and is provided with additional support by upright support member 78. Bowed support 76 should have a radius of curvature sufficient to allow a full 360° rotation of the suspended recliner in order to insure that the recliner will not collide with the support at any time. Further, it should be noted that the loop 80 attached to the bowed support by wire, or any other suitable means, should be suspended in a position centrally located of the cross-shaped base in order to provide for maximum stability of the recliner when supported by the support frame 70.

Figure 17:
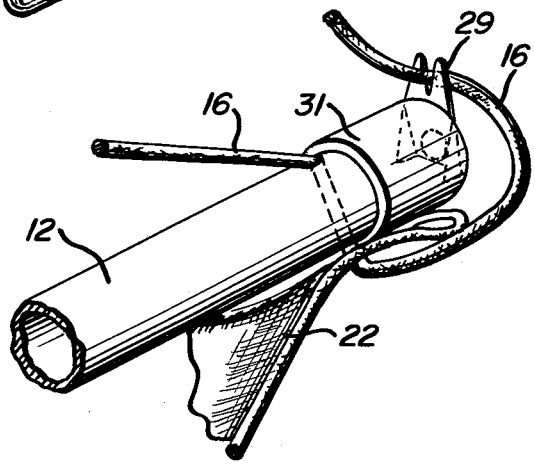
FIG. 17 is an enlarged view of an alternate modification to that shown in FIG. 15.

The three main positions which the suspended recliner may assume are clearly depicted in the drawings. FIG. 13 shows the chair-like position wherein the footrest depends vertically from the main body portion of the recliner. Upon entry of the recliner, the occupant may allow his feet to dangle from the forward fold between the body and the footrest and the recliner will act in a chair-like manner supporting the occupant's body in a somewhat vertical position and allowing the feet of the occupant to extend to the ground. When the recliner is supported in this position, it may be necessary to adjust ropes 16 and 18 in a manner as depicted in FIG. 15. In this figure, it will be seen that in order to provide adequate vertical support for the recliner, one or two turns of ropes 16 and 18 should be taken about bridle 20. In this manner, the user may lean backwards without fear of tipping the recliner. Alternatively, a clip 29, having a V-notch cut therein may be attached to the end of each spreader bar 12 and 14. FIG. 17 illustrates the use of such a clip as attached to spreader bar 12 through a threaded attachment device connected to end cap 31. The length of support rope 16, and thereby the amount of support afforded when the recliner is in the chair position may be easily adjusted by simply moving the point of engagement of rope 16 and clip 29. It will be noted that with the V-notch of clip 29 oriented with the open end of the V upward, as illustrated, the weight of the occupant serves to pull rope 16 further into the notch thus making the engagement more secure. Accordingly, it will be apparent that clip 29 provides a simple, safe and secure device for adjusting the length of support rope 16.

Figure 11:
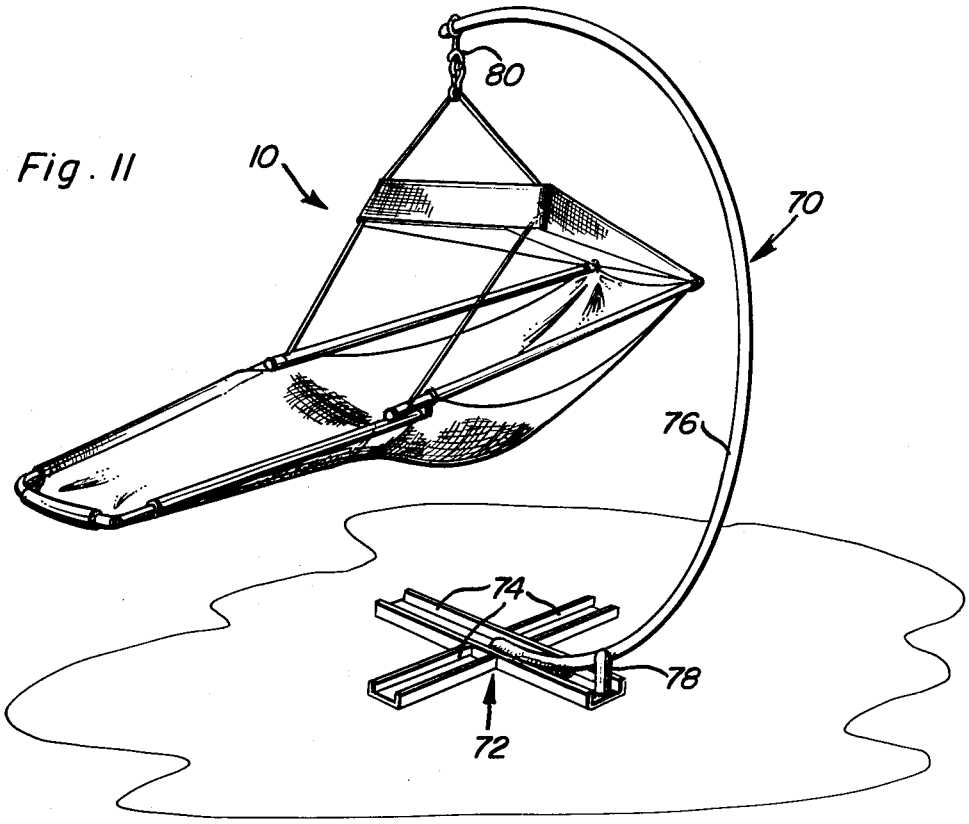
FIG. 11 is a perspective view of the suspended recliner in the full recline position.
Figure 12:
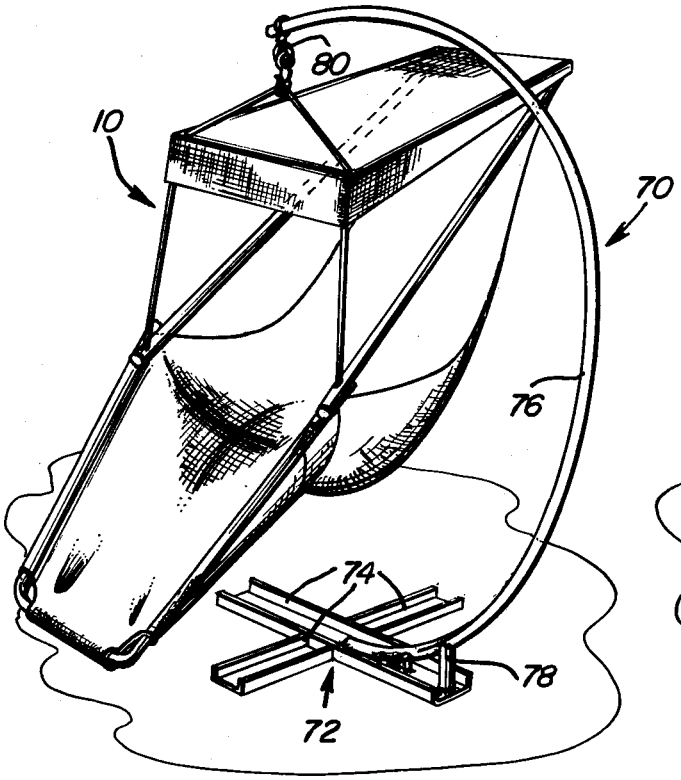
FIG. 12 is a perspective view of the suspended recliner in the semi-recline position.
Figure 13:
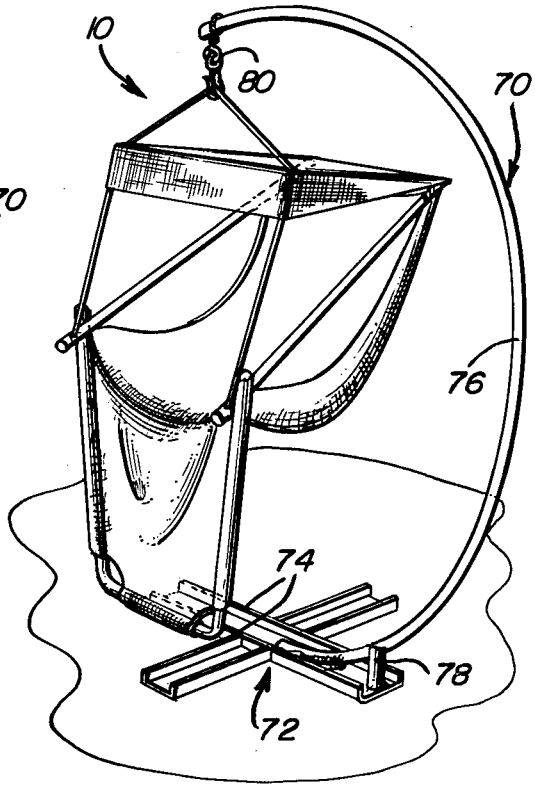
FIG. 13 is a perspective view of the suspended recliner in the chair position.

The footrest may be extended and locked into position as shown in FIGS. 11 and 12. FIG. 12 shows the recliner in its semi-reclined position wherein the body of the occupant is shifted slightly forward in the recliner in order to enable the recliner to assume a position halfway between a horizontal and a vertical orientation. In this position, the occupant's body is fully support but the occupant is allowed to have an upsitting position to facilitate the carrying on of conversations, and the like. When the occupant desires to fully recline, a shift of the body weight away from the footrest provides a weight distribution within the recliner which produces a full reclined effect as shown in FIG. 11. In this position, the recliner acts in a hammock-like manner and supports the body of the user in a horizontal manner. From the drawings, it can clearly be ascertained that entry to and exit from the recliner is facilitated by the weight distribution of the occupant within the recliner and the positions assumed by the recliner in accordance with these weight distributions together with the various orientations of the footrest with respect to the main body. Once in the position shown in FIG. 11, exit from the recliner may be easily accomplished by shifting one's weight slightly forward to assume a semi-reclined position and then gently pushing the footrest into the depending position shown in FIG. 13, whereupon one's feet are in contact with the ground and exit may be effected by merely standing up.

FIG. 14 represents a second embodiment of the invention wherein it will be seen that a double recliner designed for use by two people is set forth. This recliner is essentially the same as that of the first embodiment except for the use of wider material 22, a third spreader bar 15, an additional support rope 17, and, if desired, an additional suspension rope 53. Support rope 17 may be attached to material 22 through the use of grommets on each end of the rope. The rope may be passed through spreader bar 15, the material 22, a grommet and then knotted. Suspension rope 53 will be attached to bridle 20 by any suitable means and the opposite end is attached to hook 50 for supporting the center of the recliner.

In order to support the additional weight attendent with the use of the double recliner of FIG. 14, a tripod support frame shown at 90 should be employed. This frame has three identical lower leg portions 92. Lower legs 92 fit telescopingly within bowed upper supports 94. The upper supports 94 are connected through three sided connector 96 to form the tripod arrangement. A hook may depend from connector 96 for the recliner to hang from. Tripod 90 provides a sturdy support for the double recliner and is convenient to use. It may be dismantled easily for storage or movement. The use of three legs allows the tripod to sit evenly upon uneven ground and adds the structural support necessary for the double recliner.

Figure 18:
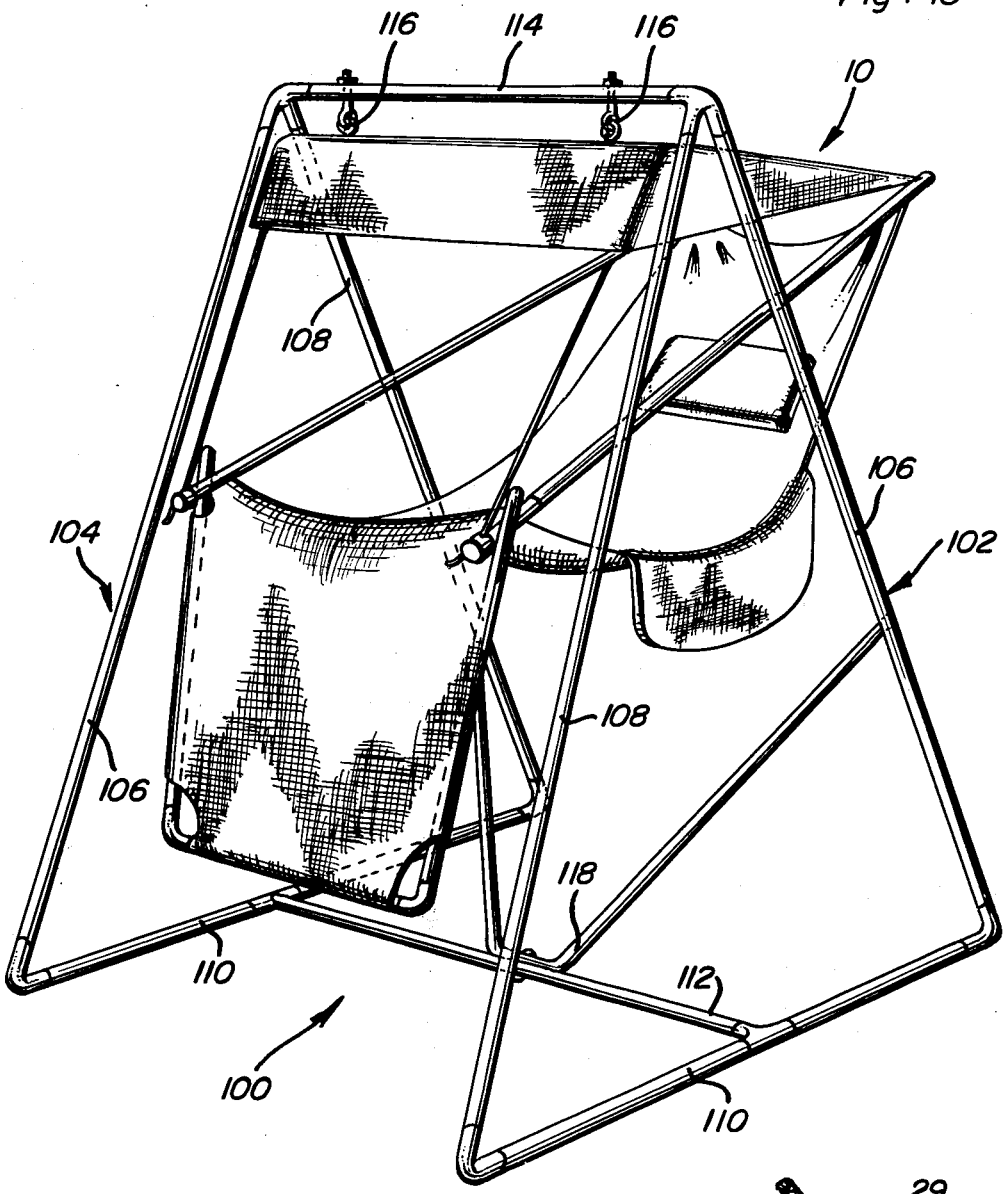
FIG. 18 is a further embodiment of the support structure for the suspended recliner.

FIG. 18 shows a further support structure for suspended recliner 10, the support structure being generally designated by the numeral 100. Support structure 100 provides greater rigidity for recliner 10 than the support structure discussed above. The support structure comprises two identical side frame members 102 and 104. Each side frame member consists of three legs forming an isosceles triangle, with the two equal legs 106 and 108 of each frame member extending away from the ground. The third leg 110 of each frame member rests upon the ground and is divided into two sections with a horizontal cross member 112 connected between the sections of each leg 110. Cross member 112 serves to keep legs 110 from separating from each other. The apexes of each side frame member formed by the joining of legs 106 and 108 are connected by horizontal support member 114. Member 114 serves as the recliner support. It will be apparent that a two point attachment is used with this embodiment. Bridle 20 is connected directly to member 114 by a pair of appropriate attachment devices, here illustrated as double ring hinges 116, it being understood that any connection allowing swinging motion of the reclient would serve as well. A final frame member 118, formed in a V-shape, connects legs 102 to the cross member 112. This member provides additional rigidity to the over-all support structure.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A suspended recliner comprising: a main body portion for supporting the body of a person; a foot support portion connected to the main body portion and adapted to support the lower extremities of a person, said foot support portion being capable of assuming a position vertically depending from said main body and a second position substantially in alignment with said main body; wherein said main body includes two longitudinally extending bar members spaced from and parallel to each other; said foot support portion comprising a footrest including a frame having two free ends with each of the free ends engaging a separate one of the bar members; and further including a support rope connected to each bar member and frame by passing through the bar member first and then the frame such that when a force is applied to the main body, the force will be transmitted through said connection to orient the frame in a plane spaced vertically below said bars, and further wherein said rope is attached to said frame at a position spaced from said free ends to form lever arms such that when the footrest is in the aligned position, each said lever arm applies a force to the bar member which force acts to keep the footrest in the aligned position; and a suspension bar extending for the width of the suspended recliner supporting said support rope and a length of rope connected from each end of the suspension bar to the main body of the suspended recliner.

2. The suspended recliner of claim 1 wherein at least one of said ropes is connected to a cap means which forms a slidable engagement with the bar to allow disengagement of the cap and rope for compact storage of the suspended recliner.

3. The suspended recliner of claim 2 and further wherein said frame includes two rigid members with each rigid member having a longitudinally extending portion and a laterally extending portion, and means for connecting the laterally extending portions to form a three-sided frame.

4. The suspended recliner of claim 1 and further including an awning extending over a portion of the main body portion.

5. The suspended recliner of claim 1 and further including an awning extending from said bar extending for the width of the suspended recliner and attached to the end of the suspended recliner opposite the foot support portion.

6. The suspended recliner of claim 1 in combination with a support frame, said frame comprising a base portion and a vertically extending suspension means for attachment to said means for supporting the suspended recliner from a single point.

7. The suspended recliner of claim 6 wherein said suspension means includes an elongated member having a vertical portion and a horizontal portion ending in a free end wherein said vertical portion is connected to said base and said free end is disposed vertically above and centrally of said base and including means on said free end for connection to said means for supporting the suspended recliner from a single point.

8. The recliner of claim 1 and further including a clip means connected to the end of each bar member opposite said foot support portion for adjusting the length of said support rope.

9. The recliner of claim 8 wherein each clip means contains a vertically oriented V-notch.

10. The recliner of claim 1 in combination with a support structure comprising a pair of laterally spaced triangular support members, a horizontal support member attached at each end to one of said triangular support members, and members for hanging the recliner from said horizontal support member.

* * * * *